US009167350B2

(12) United States Patent
Lai et al.

(10) Patent No.: US 9,167,350 B2
(45) Date of Patent: Oct. 20, 2015

(54) MAGNETIC CIRCUIT AND COAXIAL SPEAKER USING THE SAME

(71) Applicant: MERRY ELECTRONICS (SUZHOU) CO., LTD., Suzhou, Jiangsu Province (CN)

(72) Inventors: Tsai-Ti Lai, Taichung (TW); Chun-Pin Chen, Taichung (TW); Wen-Hong Wang, Taichung (TW)

(73) Assignee: MERRY ELECTRONICS (SUZHOU) CO., LTD., Suzhou (CN)

( * ) Notice: Subject to any disclaimer, the term of this patent is extended or adjusted under 35 U.S.C. 154(b) by 82 days.

(21) Appl. No.: 14/080,988

(22) Filed: Nov. 15, 2013

(65) Prior Publication Data

US 2015/0139479 A1 May 21, 2015

(51) Int. Cl.

| | |
|---|---|
| ***H04R 9/06*** | (2006.01) |
| ***H04R 9/02*** | (2006.01) |
| *H04R 1/02* | (2006.01) |
| *H04R 1/24* | (2006.01) |

(52) U.S. Cl.

CPC . *H04R 9/025* (2013.01); *H04R 1/24* (2013.01)

(58) Field of Classification Search

CPC ..... H04R 1/24; H04R 1/26; H04R 1/403; H04R 1/2834; H04R 5/02; H04R 7/12; H04R 9/02; H04R 9/025; H04R 9/10; H04R 9/046; H04R 9/047; H04R 9/06; H04R 9/063; H04R 13/02; H04R 2209/022; H04R 23/02; H04R 2400/03

USPC ..... 381/80, 82, 85, 99, 182, 184–186, 335, 381/396, 397, 412–414, 419, 420–422, 381/401; 29/594; 335/231

See application file for complete search history.

(56) References Cited

U.S. PATENT DOCUMENTS

| | | | | |
|---|---|---|---|---|
| 7,551,746 | B2 * | 6/2009 | Sagren | 381/182 |
| 2008/0317276 | A1 * | 12/2008 | Sorensen et al. | 381/401 |

* cited by examiner

*Primary Examiner* — Brian Ensey
(74) *Attorney, Agent, or Firm* — Bacon & Thomas, PLLC

(57) ABSTRACT

A magnetic circuit for coaxial speaker includes a first magnetic unit, at least one second magnetic unit arranged around the first magnetic unit and at least one third magnetic unit arranged around the at least one second magnetic unit. The magnetic pole arrangement of the second magnetic unit is reversed to the magnetic pole arrangement of the first magnetic unit and the third magnetic unit, enabling a first magnetic loop to be established between the first magnetic unit and the at least one second magnetic unit and a second magnetic loop to be established between the at least one second magnetic unit and the at least one third magnetic unit. The magnetic circuit is practical for use in the inner and outer drivers of a coaxial speaker, providing uniform magnetic field distribution, and facilitating speaker miniaturization.

10 Claims, 7 Drawing Sheets

MAGNETIC CIRCUIT AND COAXIAL SPEAKER USING THE SAME

BACKGROUND OF THE INVENTION

1. Field of the Invention

The present invention relates to a magnetic circuit for use in a coaxial speaker, and more particularly, to a magnetic circuit that shares a common magnetic loop and is capable of providing a uniform magnetic field distribution, improving the voice coil driving efficiency and effectively reducing the overall size of the speaker.

2. Description of the Related Art

With increasing competitiveness in today's electronic product market, is becoming more competitive, every manufacturer requirements on the specifications of speaker for electronic products have become more critical than ever. Not only hope the speaker size to be more compact size to fit thin electronic product design, but also want the speaker to provide a wide range of audio output. It is therefore often necessary to install a second driver, promoting the creation of coaxial speaker.

Various coaxial speakers are known. For example, a conventional coaxial speaker 80 as shown in FIG. 1, which comprises a low range driver 81 and a mid-high range driver 82. The low range driver 81 and the mid-high range driver 82 respectively comprise an independent diaphragm 83 and an independent magnetic circuit 84. The mid-high range driver 82 is coaxially mounted in the center of an accommodation area within low range driver 81. However, because the two drivers are respectively disposed at different elevations and have different sizes, the overall thickness of this design of coaxial speaker 80 is greatly increased. Obviously, this design of coaxial speaker does not meet the requirements of the electronic market. Further, the magnetic lines of force of the magnet are emitted from the N pole to pass through the two opposite lateral sides of the magnet to the S pole thereof. However, a regular magnetic circuit simply uses the magnetic field at one lateral side of the magnet, as shown in FIG. 2, and a severe magnetic flux leakage can occur at the opposite lateral side. Therefore, an improvement in this regard is necessary.

SUMMARY OF THE INVENTION

The present invention has been accomplished under the circumstances in view. It is the main object of the present invention to provide a magnetic circuit and a coaxial speaker using the magnetic circuit, which enables the magnetic units of multiple drivers to shape a common magnetic loop, reducing magnetic flux leakage and the overall size of the speaker.

To achieve this and other objects of the present invention, a magnetic circuit for coaxial speaker of the present invention comprises a first magnetic unit, at least one second magnetic unit arranged around the first magnetic unit, and at least one third magnetic unit arranged around the at least one magnetic unit first magnetic unit, wherein the magnetic pole arrangement of the second magnetic unit is opposite to the magnetic pole arrangement of the first magnetic unit and third magnetic unit so that a first magnetic loop is established between the first magnetic unit and the at least one second magnetic unit, and a second magnetic loop is established between the at least one second magnetic unit and the at least one third magnetic unit.

Thus, the at least one second magnetic unit can be shared by the first magnetic loop and the second magnetic loop, achieving effective use of the magnetic fields at the two sides of the at least one second magnetic unit to reduce magnetic flux leakage and providing a uniform magnetic field distribution.

Further, the invention provides a coaxial speaker, which comprises the aforesaid magnetic circuit, an inner driver and an outer driver coaxially arranged around the inner driver. The inner driver comprises an inner diaphragm. The outer driver comprises an outer diaphragm kept away from the inner diaphragm. The inner diaphragm comprises an inner voice coil drivable by the first magnetic loop of the magnetic circuit. The outer diaphragm comprises an outer voice coil drivable by the second magnetic loop of the magnetic circuit.

Thus, the diaphragms and voice coils of the inner and outer drivers are respectively drivable by the first magnetic loop and the second magnetic loop to output sounds in different audio frequency ranges. Further, the inner and outer drivers share the common second magnetic unit, facilitating the overall size of the coaxial speaker.

It is worth mentioning that the number of the at least one second magnetic unit and the number of the at least one third magnetic unit can be 1. In this case, the single second magnetic unit and the single third magnetic unit have an annular shape. Alternatively, the number of the at least one second magnetic unit can be multiple, the number of the at least one third magnetic unit can also be multiple, and the multiple second magnetic units and the multiple third magnetic units are respectively arranged in a circle.

Other advantages and features of the present invention will be fully understood by reference to the following specification in conjunction with the accompanying drawings, in which like reference signs denote like components of structure.

DETAILED DESCRIPTION OF THE INVENTION

Figure 1:
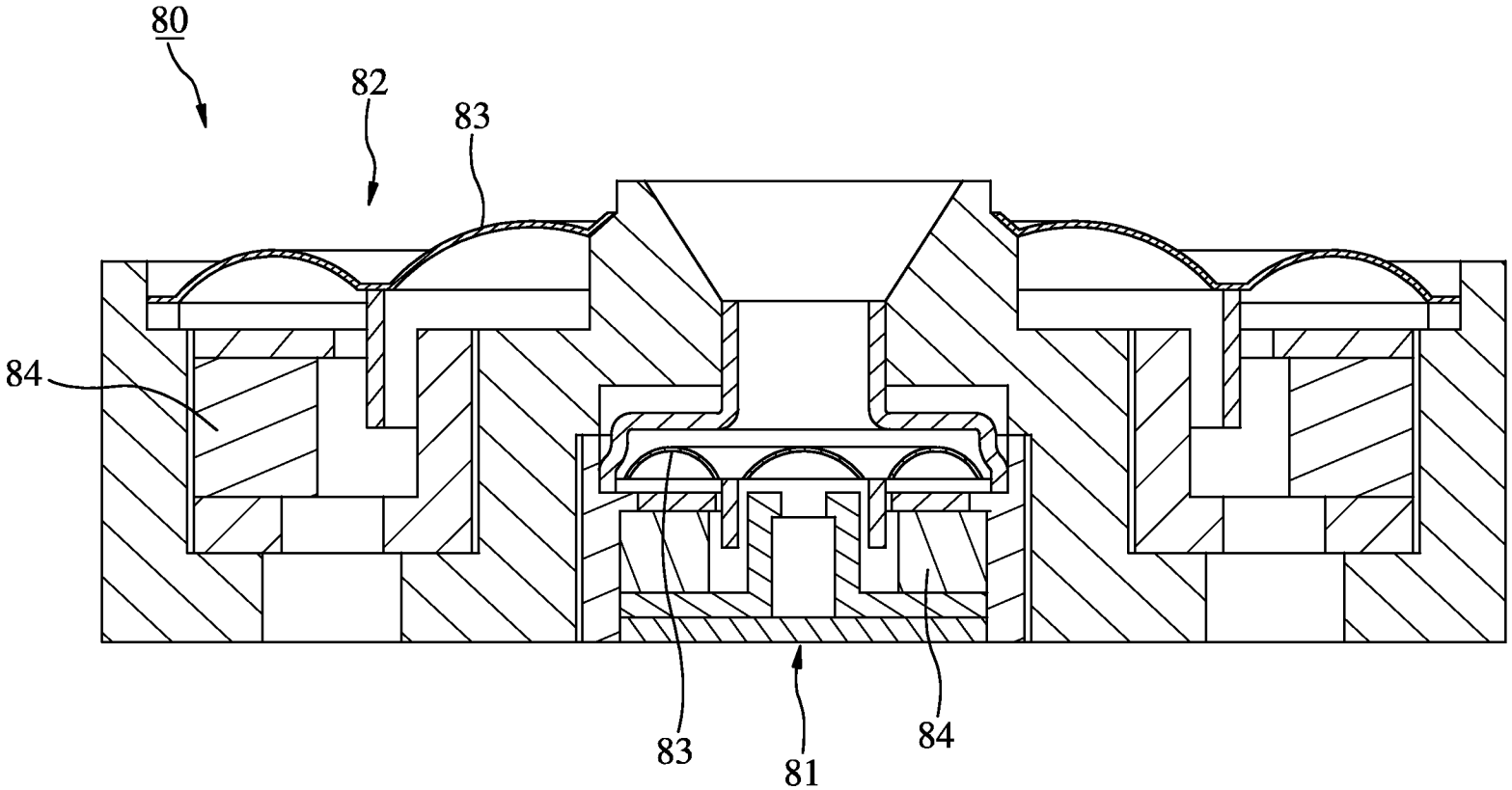
FIG. 1 PRIOR ART
FIG. 1 is a sectional view of a conventional coaxial speaker.
Figure 2:
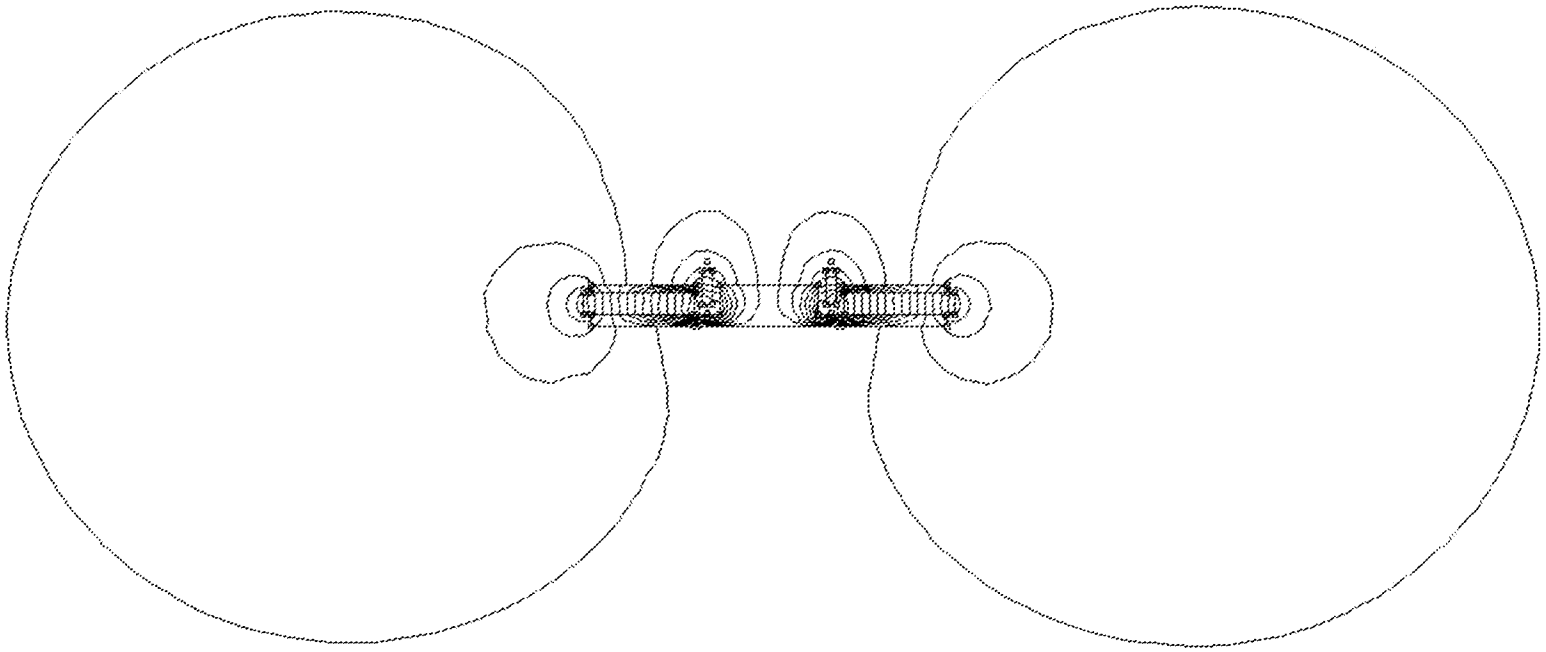
FIG.2 PRIOR ART
FIG. 2 illustrates the distribution of magnetic lines of force of the magnetic circuit in a conventional in accordance with a first embodiment of the present invention.
Figure 3:
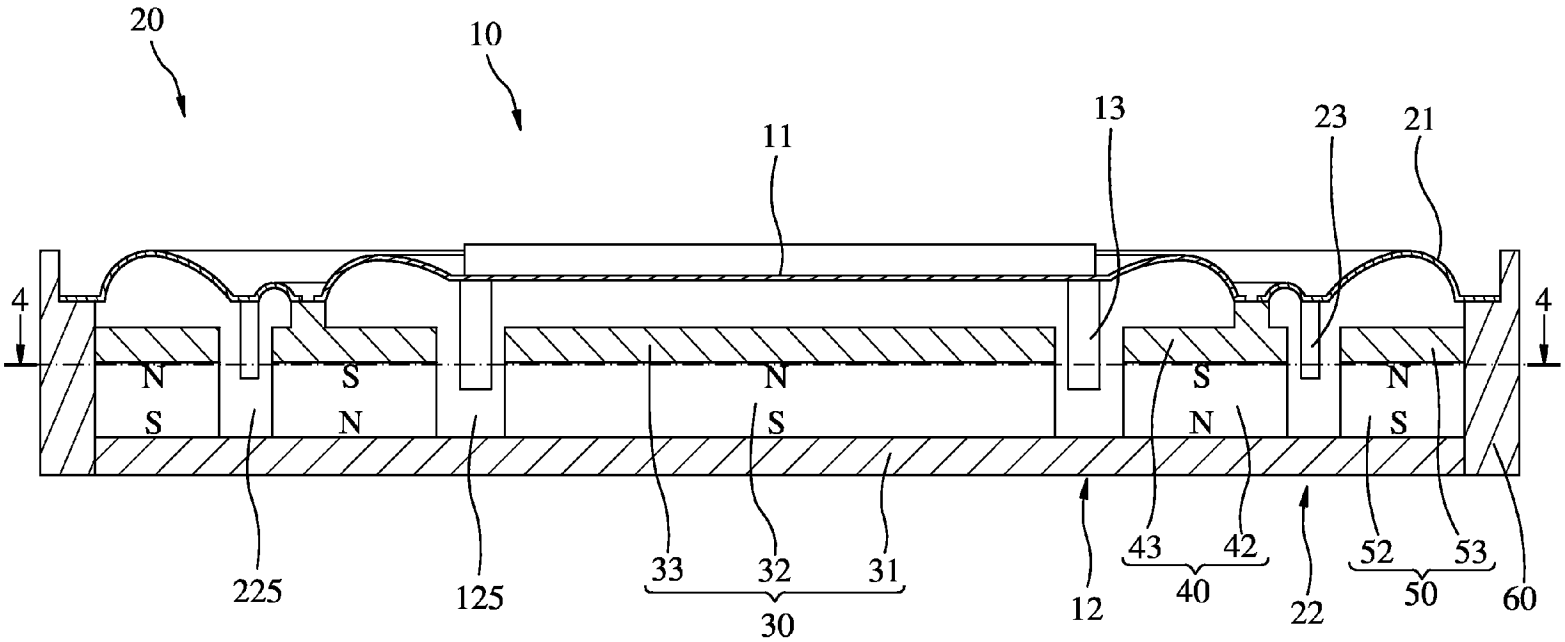
FIG. 3 is a sectional elevational view of a coaxial speaker in accordance with a first embodiment of the present invention.
Figure 4:
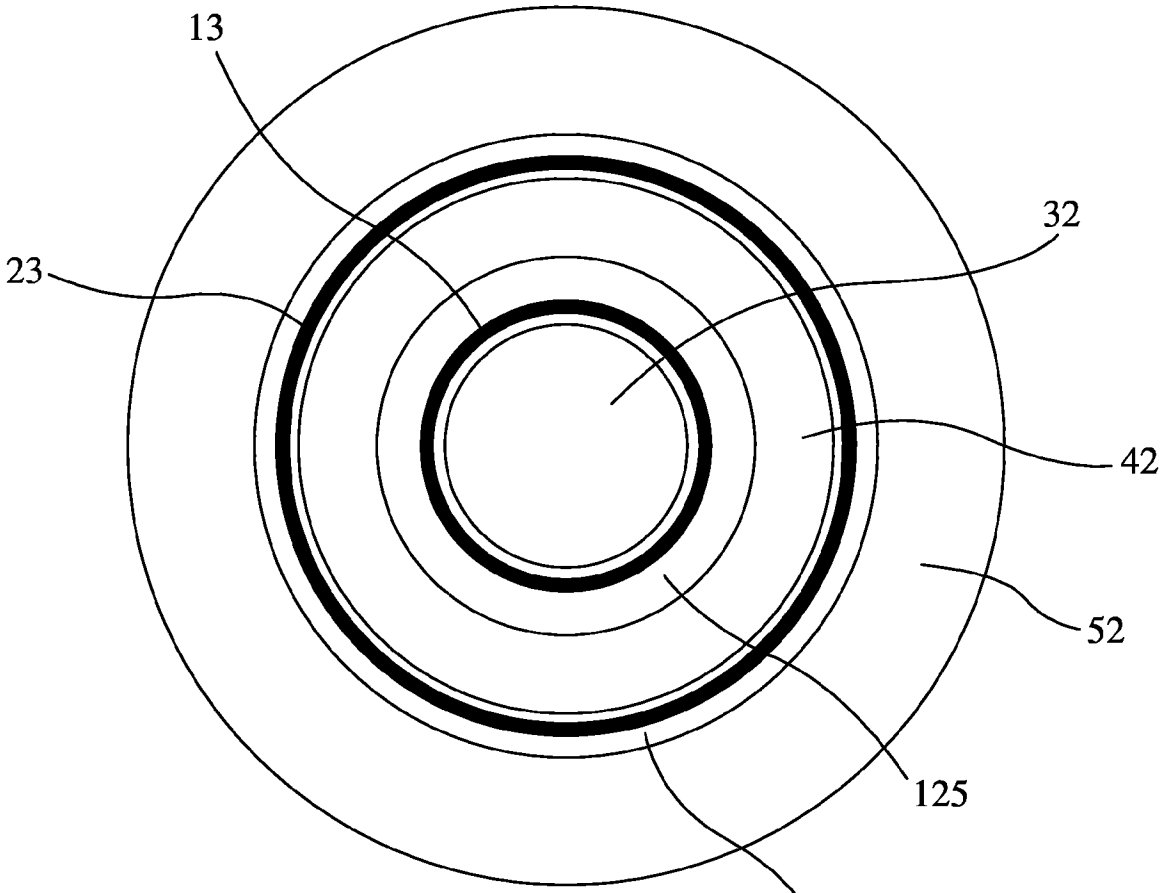
FIG. 4 is a sectional view taken along line 4-4 of FIG. 3.

For easily understanding the structural details and features of the present invention, a first embodiment is provided in the form of a coaxial speaker. As illustrated in FIGS. 3 and 4, the coaxial speaker comprises a cabinet 60, an inner driver 10 and an outer driver 20 coaxially accommodated in the cabinet 60. The inner driver 10 is adapted for the output of a low frequency range. The outer driver 20 is adapted for the output of a high frequency range.

Referring to FIG. 3, the inner driver 10 comprises an inner diaphragm 11, a first magnetic loop 12, and an annular outer voice coil 13. The annular outer voice coil 13 is mounted at one side of the inner diaphragm 11 and partially received within the first magnetic loop 12, enabling the first magnetic loop 12 to produce a magnetic field induction with the electric current passing through the inner voice coil 13 and to further drive the inner diaphragm 11 to vibrate. The first magnetic loop 12 is formed of a first magnetic unit 30 and a second magnetic unit 40. The first magnetic unit 30 has a circular shape. The second magnetic unit 40 has an annular shape and is spaced around the first magnetic unit 30, and thus, as shown in FIG. 4, a magnetic gap 125 is defined between the first magnetic unit 30 and the second magnetic unit 40 for accommodating the inner voice coil 13.

The outer driver 20 is coaxially arranged around the inner driver 10, comprising an outer diaphragm 21, a second magnetic loop 22 and an annular outer voice coil 23. The annular outer voice coil 23 is mounted at one side of the outer diaphragm 21 and partially received within the second magnetic loop 22, enabling the second magnetic loop 22 to produce a magnetic field induction with the electric current passing through the outer voice coil 23 and to further drive the outer diaphragm 21 to vibrate. The second magnetic loop 22 is established using the aforesaid second magnetic unit 40 and a third magnetic unit 50. The third magnetic unit 50 has an annular shape, and is spaced around the second magnetic unit 40, and thus, as shown in FIG. 4, a magnetic gap 225 is defined between the second magnetic unit 40 and the third magnetic unit 50 for accommodating the outer voice coil 23.

The aforesaid first magnetic unit 30, second magnetic unit 40 and third magnetic unit 50 establish a magnetic circuit that is formed by stacking up one magnetic yoke 31 with three magnets 32,42,52 and three concentrating flux plates 33,43,53, wherein the magnetic north pole of the magnet 43 of the second magnetic unit 40 faces downwardly toward the magnetic yoke 31. The magnetic north poles of the magnets 32,42 of the first and second magnetic units 30,50 respectively face upwardly toward the concentrating flux plates 33,53. Thus, the magnetic pole arrangement (the direction of the magnetic moment of the magnet, i.e., the direction of the magnetic south pole of the magnet that points out the magnetic north pole) of the second magnetic unit 40 is reversed to the magnetic pole arrangement of the first magnetic unit 30.

It is to be noted that the magnetic yoke 31 and the concentrating flux plates 33,43,53 are made of a high magnetic conductivity material, for example, cold rolled steel. Further, the magnets 32,42,52 can be ferrite magnets or rare earth magnets, however, rare earth magnets are better.

Figure 5:
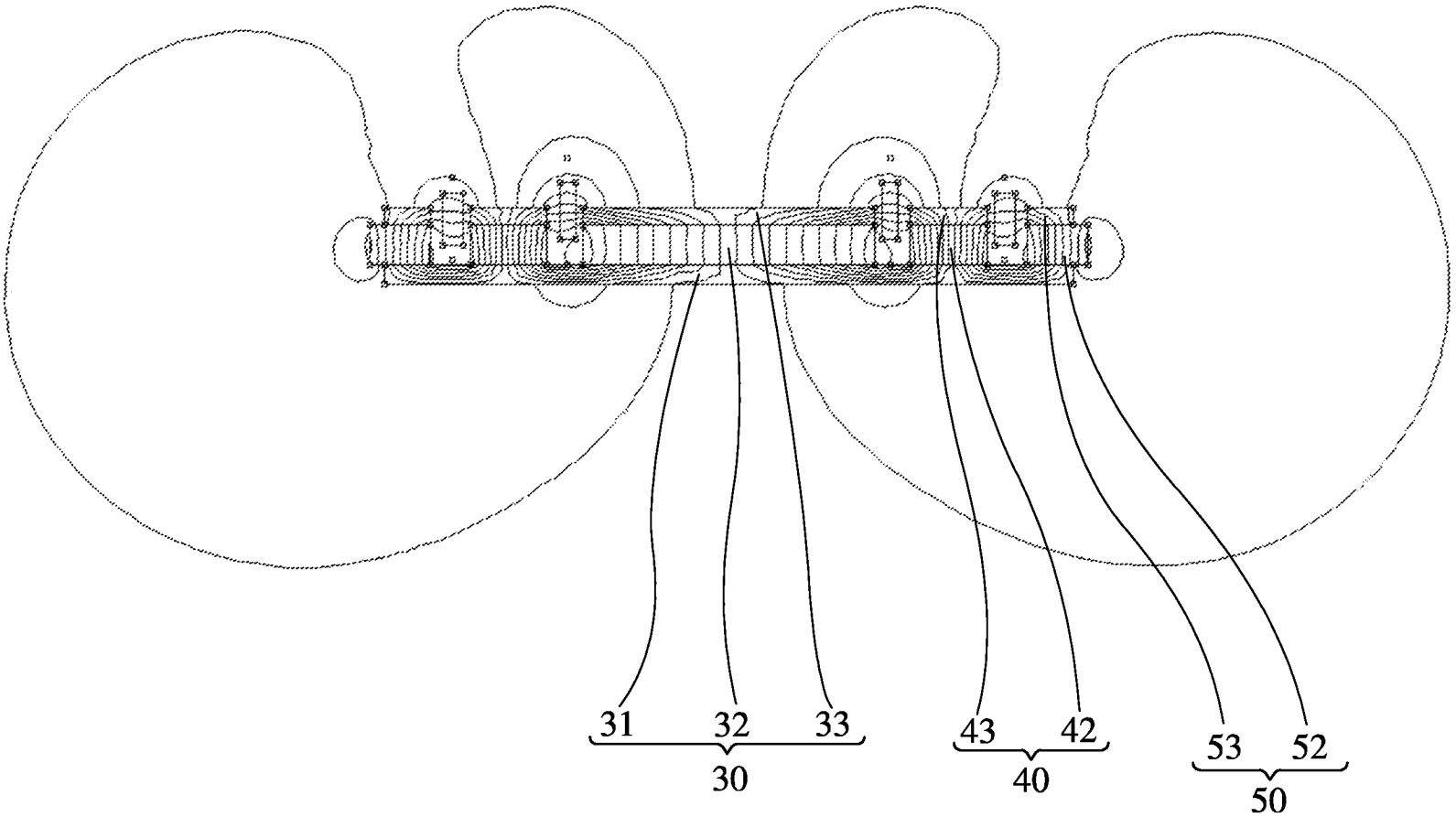
FIG. 5 illustrates the distribution of magnetic lines of force of the magnetic circuit of the coaxial speaker in accordance with the first embodiment of the present invention.

Thus, as shown in FIG. 5, the second magnetic unit 40 can be shared by the first magnetic loop 12 and the second magnetic loop 22 to induce with the first magnetic unit 30 or the third magnetic unit 50 a uniform magnetic field in the magnetic gap 125 or 225, avoiding a magnetic flux leakage and improving the efficiency in driving the inner voice coil 13 and the outer voice coil 23. Further, enabling the second magnetic unit 40 to be shared by the first magnetic loop 12 and the second magnetic loop 22 greatly saves material consumption and reduces the speaker size.

It is worth mentioning that the aforesaid inner diaphragm 11 and outer diaphragm 21 can be connected together and combined into a single diaphragm, and the inner voice coil 13 with the outer voice coil 23 can be coaxially mounted at this single diaphragm to reduce the overall size of the speaker, enabling the speaker to have a flattened appearance of simplicity that is in line with the market trend in the design of electronic products.

Figure 6:
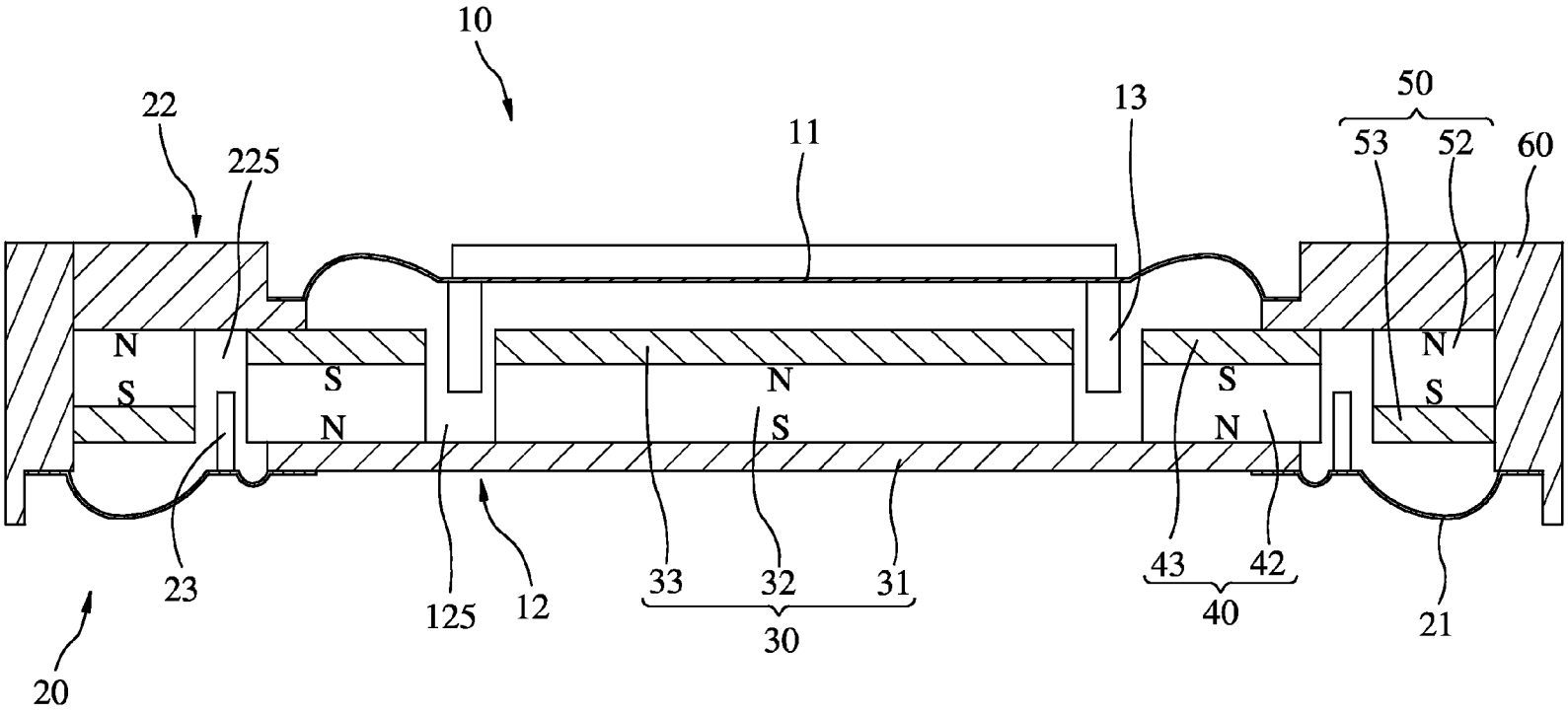
FIG. 6 is a sectional view of a coaxial speaker in accordance with a second embodiment of the present invention.
Figure 7:
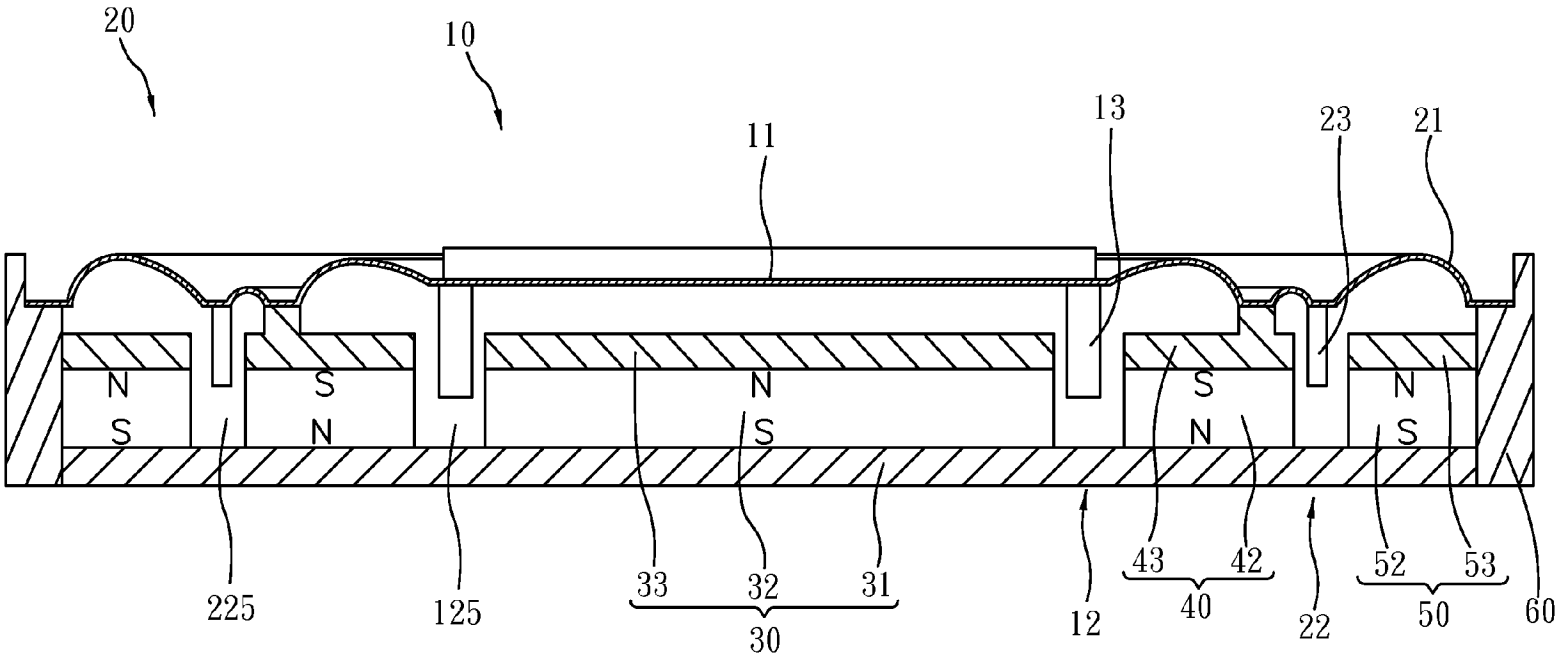
FIG. 7 is a sectional elevational view of a coaxial speaker showing the inner and outer diaphragms connected together to form a combination diaphragm.

Referring to FIG. 6, a coaxial speaker in accordance with a second embodiment of the present invention is shown. This second embodiment is substantially similar to the aforesaid first embodiment with the exception that the inner diaphragm 11 of the inner driver 10 and the outer diaphragm 21 of the outer driver 20 are respectively mounted at opposing top and bottom sides of the speaker. The third magnetic unit 50 is simply formed of the magnet 52 and the concentrating flux plate 53 and mounted within the cabinet 60, The magnet 32 of the first magnetic unit 30 and the magnet 42 of the second magnetic unit 40 are mounted at the magnetic yoke 31. Thus, the magnetic circuit of the coaxial speaker in accordance with this second embodiment of the present invention can also exerts its effects, enabling the inner diver 10 and the outer driver 20 to provide different sound output in different directions.

It is worth mentioning that the number of the drivers in accordance with the present invention is not limited to 2, i.e., the coaxial speaker can be made having three or more drivers. The installation of the magnetic units is not restricted to one same magnetic yoke. Further, multiple second magnetic units and multiple third magnetic units can be used and respectively arranged in a circle. For example, four second magnetic units each comprised of a rectangular magnetic yoke, a rectangular magnet and a rectangular concentrating flux plate can be used and respectively disposed at four sides around the first magnetic unit and, four third magnetic units each comprised of a rectangular magnetic yoke, a rectangular magnet and a rectangular concentrating flux plate can also be used and respectively disposed at an outer side relative to the second magnetic units. In this arrangement, two magnetic gaps are provided for accommodating the voice coils of the inner and outer diaphragms respectively. Further, any person skilled in the art can change the magnetic pole arrangement of every magnetic unit subject to actual needs, maintaining the magnetic pole arrangement of the second magnetic unit opposite to the magnetic pole arrangement of the first and third magnetic units to achieve the effects of the present invention. Modifications in this regard can be made without departing from the spirit and scope of the invention.

What is claimed is:

1. A magnetic circuit for coaxial speaker, comprising a first magnetic unit, at least one second magnetic unit arranged around said first magnetic unit and at least one third magnetic unit arranged around said at least one second magnetic unit, wherein the magnetic pole arrangement of said second magnetic unit is reversed to the magnetic pole arrangement of said first magnetic unit and said third magnetic unit, enabling a first magnetic loop to be established between said first magnetic unit and said at least one second magnetic unit and a second magnetic loop to be established between said at least one second magnetic unit and said at least one third magnetic unit.

2. The magnetic circuit for coaxial speaker as claimed in claim 1, wherein said first magnetic unit, said at least one second magnetic unit and said at least one third magnetic unit each comprise a magnetic yoke, a magnet and a concentrating flux plate arranged in a stack in a proper order.

3. The magnetic circuit for coaxial speaker as claimed in claim 2, wherein said first magnetic unit, said at least one second magnetic unit and said at least one third magnetic unit share one common magnetic yoke.

4. The magnetic circuit for coaxial speaker as claimed in claim 2, wherein the number of said at least one second magnetic unit and the number of said at least one third magnetic unit are 1, and the single said second magnetic unit and the single said third magnetic unit have an annular shape.

5. The magnetic circuit for coaxial speaker as claimed in claim 2, wherein the number of said at least one second magnetic unit and the number of said at least one third magnetic unit are multiple, and the multiple said second magnetic units and the multiple said third magnetic units are respectively arranged in a circle.

6. A coaxial speaker, comprising a magnetic circuit constructed as claimed in claim 1, an inner driver and an outer driver coaxially arranged around said inner driver, said inner driver comprising an inner diaphragm, said outer driver comprising an outer diaphragm kept away from said inner diaphragm, said inner diaphragm comprising an inner voice coil drivable by the first magnetic loop of said magnetic circuit, said outer diaphragm comprising an outer voice coil drivable by the second magnetic loop of said magnetic circuit.

7. The coaxial speaker as claimed in claim 6, wherein the output audio frequency range of said inner diaphragm is lower than the output audio frequency range of said outer diaphragm.

8. The coaxial speaker as claimed in claim 6, wherein said inner diaphragm and said outer diaphragm are respectively mounted at two opposite sides of the coaxial speaker.

9. The coaxial speaker as claimed in claim 7, wherein said inner diaphragm and said outer diaphragm are respectively mounted at two opposite sides of the coaxial speaker.

10. A coaxial speaker, comprising a magnetic circuit constructed as claimed in claim 1, an inner driver and an outer driver coaxially arranged around said inner driver, said inner driver comprising an inner diaphragm, said outer driver comprising an outer diaphragm kept away from said inner diaphragm, said inner diaphragm and said outer diaphragm being connected together and combined into a combination diaphragm, said combination diaphragm comprising an inner voice coil and an outer voice coil respectively drivable by the first magnetic loop and second magnetic loop of said magnetic circuit.

* * * * *